US007621344B2

(12) United States Patent
Frey

(10) Patent No.: US 7,621,344 B2
(45) Date of Patent: Nov. 24, 2009

(54) DRILL PIPE WIPER SYSTEM AND ASSOCIATED METHOD

(76) Inventor: Grant J. Frey, 13310-108 Street, Edmonton, Alberta (CA) T5E 4X5

( * ) Notice: Subject to any disclaimer, the term of this patent is extended or adjusted under 35 U.S.C. 154(b) by 119 days.

(21) Appl. No.: 11/825,805

(22) Filed: Jul. 10, 2007

(65) Prior Publication Data

US 2009/0014182 A1 Jan. 15, 2009

(51) Int. Cl.
*E21B 33/08* (2006.01)
*E21B 33/02* (2006.01)

(52) U.S. Cl. ..... 175/84; 166/84.1; 15/104.04; 15/256.5

(58) Field of Classification Search ..... 175/84; 166/177.3, 84.1; 15/104.04, 256.5
See application file for complete search history.

(56) References Cited

U.S. PATENT DOCUMENTS 2,718,021 A 9/1955 Baebel
2,809,012 A 10/1957 Stevens
3,733,641 A 5/1973 Brown
4,457,366 A 7/1984 Brown
4,690,213 A 9/1987 Stannard et al.
4,895,205 A * 1/1990 Thompson et al. ..... 166/90.1
4,982,787 A 1/1991 Reddoch
5,170,853 A 12/1992 Mason et al.
5,842,252 A 12/1998 Cameron et al.
5,921,316 A 7/1999 McMinn

* cited by examiner

*Primary Examiner*—Giovanna C Wright

(57) ABSTRACT

The drill pipe wiper system includes a plurality of coextensively shaped rectilinear support rails with axially opposed ends with a plurality of openings formed in the opposed ends of the support rails, a plurality of ports penetrating an outer surface of the support rails, and a plurality of spring-loaded latch pins. The system further includes a plurality of coextensively shaped rectilinear end rails and a mechanism for attaching the support rails to a support surface. The support rail attaching mechanism includes a plurality of coextensively shaped rectilinear beams, a plurality of cotter pins, a plurality of coupling members monolithically formed with the second ends of the shafts, and a rectilinear channel. A moisture removing mechanism includes a carrier assembly with a first plate, a second plate, a plurality of first slider guides, a third plate, a fourth plate, a plurality of second slider guides, and wiper pads.

16 Claims, 8 Drawing Sheets

DRILL PIPE WIPER SYSTEM AND ASSOCIATED METHOD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to wiper systems and, more particularly, to a drill pipe wiper system for removing moisture from an outer surface of an existing drill pipe while the existing drill pipe is being removed from a ground surface.

2. Prior Art

Well drilling units are employed in prospecting for gaseous and liquid minerals and for bringing them to the surface. Because of the need for drilling to greater depths, as well as improving the speed of the drilling operation, traditional precision drilling techniques have been superseded by continuous rotary drilling. Rotary drilling utilizes rotational motion of a bit to drill the well bore. The bit is attached to a drill string which is comprised of drill collars, a drill pipe and a kelly joint. At the surface, rotational motion is imparted on the drill string by a rotary table to which the kelly joint is attached.

The drill cuttings produced by the bit that operates at the bottom of the well bore are carried to the earth's surface by circulating drilling fluids, i.e. drilling mud. That is, the drilling fluids are continuously pumped down the well bore through the kelly joint, and the drill pipe and the bit are recirculated to the surface. As drilling progresses, new joints of drill pipe are added. This process is commonly known in the art as "making a connection".

Conversely, the drill string must also be removed periodically to replace worn bits and damaged drill pipe. This process in commonly known in the art as "tripping out". Tripping out is performed by removing two to four joints of drill pipe at a time, depending upon the size of the derrick of the well drilling unit. A consequence of tripping out is spillage of drilling fluids because as the drill pipe is removed from the well bore drilling fluids drain from the inside and outside of the drill pipe. The spillage results in drilling fluids being wasted and rig workers being exposed to unsafe working conditions.

To prevent fluid drainage from the drill pipe during tripping out, pipe wipers have herefore been utilized to wipe the outside surface of the drill pipe as the drill pipe is hoisted out of the well bore. However, when employing the housing assemblies of the prior art to support the pipe wipers problems have been encountered in that the drilling fluids are not uniformly removed from the outside surface of the drill pipe. For example, when the shims are removed from the rotary table in order to allow tripping out of the drill pipe, the drill pipe can vertically move or sway which results in uneven wiping of the external surface of the drill pipe, as well as causing excessive wear on the pipe wipers.

U.S. Pat. No. 5,921,316 to McMinn discloses an automatic pipe wiping system using a circular air manifold with jets which are automatically triggered to flow air at the pipe. The pipe is wiped, even when moving laterally with crooked pipe. The pipe is air blown to wipe the mud down. The air jets have a pneumatic logic circuit that senses upward pipe movement and starts air flow to a manifold around the pipe. Unfortunately, this prior art example does not provide a means for quickly changing a wiper pad during operation of the system.

U.S. Pat. No. 5,842,252 to Cameron discloses a pipe wiper assembly for stripping fluid from oil and gas well strings which has a pair of rams which can move from a first remote position relative to the pipe forward to a second position contacting and wiping the pipe and forward to a third position when the pipe is not in the oil or gas well to protectively cover the well. The rams are mounted in a carrier which has freedom of movement in any radial direction to allow the rams to be centralized around the oil or gas well string. The unit also has alignment guides such that when the rams are returned to the first position, the rams and carrier will be centralized over the well bore and the freedom of radial movement is eliminated. Unfortunately, this prior art example does not provide a means for quickly changing a wiper pad during operation of the system.

U.S. Pat. No. 5,170,853 to Mason discloses a pipe wiper assembly that comprises a first housing for supportingly receiving at least one resilient wiper member. A second housing is supported above the well bore for connecting the first housing to the stack assembly of the drilling unit. The first and second housings are interconnected such that the first housing is selectively movable in response to vertical deviations of the drill pipe as the drill pipe is withdrawn from the vertically extending well bore. Unfortunately, this prior art example does not provide a means for collecting the wiped fluid and redistributing said fluid back into the circulation system.

Accordingly, the present invention is revealed in order to overcome the above noted shortcomings. The present invention satisfies such a need by providing a system that is convenient and easy to use, durable in design, and designed for removing moisture from an outer surface of an existing drill pipe while the existing drill pipe is being removed from a ground surface. The drill pipe wiper system includes a mud skirt for directing the flow of wiped fluids back into the circulation system. In addition, the wiper pads can be quickly replaced when needed, even during operation of the drill. The present invention is simple to use, affordable, and designed for many years of repeated use.

BRIEF SUMMARY OF THE INVENTION

In view of the foregoing background, it is therefore an object of the present invention to provide a system for removing moisture from an outer surface of an existing drill pipe while the existing drill pipe is being removed from a ground surface. These and other objects, features, and advantages of the invention are provided by a drill pipe wiper system.

The drill pipe wiper system includes a plurality of coextensively shaped rectilinear support rails with axially opposed ends. Each of such support rails effectively has a plurality of openings formed in the opposed ends of the support rails and located adjacent to a vertical edge thereof. Each of such openings has a centrally registered axis oriented at a right angle to the longitudinal length of the support rails, and the openings are equidistantly spaced along a vertical plane registered parallel to the vertical edge of the opposed ends of the support rails.

Each of such support rails further includes a plurality of ports penetrating an outer surface of the support rails and equidistantly spaced therealong. Selected ones of such ports is located adjacent to a top edge of the support rails while other ones of the ports are located adjacent to a bottom edge of the support rails. Each support rail further conveniently includes a plurality of flanges directly attached to the outer surfaces of the support rails and extending outwardly and away therefrom. Each of such flanges has a first portion oriented along the horizontal plane and further has a second portion oriented upwardly and along the vertical plane.

Such a first portion of the flange is advantageously located subjacent to an associated one of the ports of the support rails, and such a second portion is spaced from the outer surface of the support rails and further has a hole formed therein. Each of such holes has a centrally registered axis aligned with a centrally registered axis of an associated one of the ports of the support rails. The respective centrally aligned axes are oriented perpendicular to the longitudinal length of the support rails.

The support rail further includes a plurality of spring-loaded latch pins suitably shaped and sized such that a distal end of the latch pins simultaneously penetrates the holes of the second portions of the flanges and the ports of the support rails respectively. Such distal ends of the latch pins directly contact the walls and the third and fourth plates respectively of the carrier assembly in such a manner that the carrier assembly is prohibited from prematurely and undesirably exiting the hollow chamber during operating procedures. Each of the latch pins further has a second end oriented perpendicular to the distal end of the latch pin.

The system further includes a plurality of coextensively shaped rectilinear end rails with right and left ends respectively. Each of such end rails is directly attached to the respective opposed ends of the support rails. Each of the end rails effectively includes a plurality of flattened tabs monolithically formed in the right and left ends respectively of the end rails and extending outwardly and away therefrom. Each of such tabs has a top surface oriented in parallel with a top surface of the end rails. The tabs are equidistantly spaced along the respective right and left ends of the end rails, and each of the tabs has an aperture formed in a center region thereof and penetrating therethrough.

The end rails further include a plurality of linch pins suitably sized and shaped for penetrating through associated ones of the apertures of the tabs, and the tabs of the end rails are interfitted within associated ones of the openings of the support rails such that the end rails and the support rails respectively cooperate to form a substantially rectangular-shaped structure. Such a structure conveniently has a hollow chamber formed therein. The linch pins and the tabs of the ends rails respectively cooperate to prevent the end rails from prematurely and undesirably separating from the support rails and thereby maintain the ends rails and the support rails in a fixed and static position during operating conditions.

The system further includes a mechanism for attaching the support rails to a support surface. Such an attaching mechanism is directly connected to the respective opposed ends of the support rails and disposed subjacent thereto. The support rail attaching mechanism includes a plurality of coextensively shaped rectilinear casings with axially opposed open ends. Each of such casings advantageously has a hollow interior such that a continuous passageway extends along the entire longitudinal length thereof, and each of the opposed ends has a threaded interior surface. Each of the casings is integrally attached directly to an interior surface of an associated one of the support rails along the longitudinal length thereof and has a longitudinal length that is equal to each of the longitudinal lengths of the support rails.

The casings further have a bottom surface registered in parallel with a lower edge of the support rails and further is disposed subjacent thereto. Each of the casings effectively has a plurality of bores formed in opposed lateral faces of each of the opposed ends thereof and has a centrally registered axis oriented at a right angle to the longitudinal length of the casing. A lower edge of the end rails abuts directly against a top surface of the casings when the end rails are attached to the support rails.

The support rail attaching mechanism further includes a plurality of coextensively shaped rectilinear beams with axially opposed first and second ends respectively. Such beams are telescopically interfitted within the passageways of the casings, and each of the beams has a plurality of holes formed in opposed lateral surfaces thereof and equidistantly spaced along a longitudinal length thereof. Such holes conveniently align with associated ones of the bores to provide a continuous conduit therethrough.

The support rail attaching mechanism further includes a plurality of cotter pins simultaneously penetrated through the bores and the openings when the beams are interfitted within the casings for prohibiting the beams from prematurely and undesirably separating during operating conditions. The mechanism further includes a plurality of threaded shafts with axially opposed first and second ends respectively where the first ends of the shafts are removably attached to the first ends of the beams. Such shafts advantageously have a longitudinal length registered in parallel with the longitudinal lengths of the beams.

The mechanism further includes a plurality of coupling members monolithically formed with the second ends of the shafts. Such coupling members effectively include flattened plates and U-shaped hooks. The coupling members are for removably attaching the support rails to the support surface. Finally, the support rail attaching mechanism includes a plurality of adjusting nuts threadably attached to the shafts and intercalated between the first and second ends thereof.

The system further includes a rectilinear channel integrally attached to the support rail attaching mechanism for directing drilling fluid back towards the existing drill rig circulating system and a mechanism for removing moisture from the outer surface of the existing drill pipe. Such a moisture removing mechanism is directly attached to the support rails and includes a carrier assembly that includes a first plate provided with opposed open and closed ends respectively and has a plurality of walls extending upwardly at a right angle from a top surface thereof. The walls of the carrier assembly are contiguously oriented along laterally opposed outer edges of the first plate, the walls extending along an entire longitudinal length of the first plate, each of the walls has a groove formed in an exterior surface thereof and conveniently extending along a longitudinal length thereof, a plurality of spacers monolithically formed with a bottom surface of the first plate and extending downwardly and away therefrom, The carrier assembly of the moisture removing mechanism further includes a second plate coextensively shaped with the first plate and has a top surface monolithically formed with the spacers such that the spacers are intercalated between the first plate and the second plates respectively. Such a second plate advantageously has laterally opposed edges folded downwardly and inwardly toward a centerline of a bottom surface of the second plate such that each of the edges forms a continuous groove along the longitudinal length of the second plate.

The carrier assembly further includes a plurality of first slider guides interfitted within the folds of the second plate and statically attached thereto. Such first slider guides effectively extend along a longitudinal length of the folds. The carrier assembly further includes a third plate provided with opposed open and closed ends; a fourth plate coextensively shaped with the third plate and a plurality of second slider guides monolithically formed with a bottom surface of the third plate and a top surface of the fourth plate such that the second slider guides are intercalated between the third and fourth plates respectively.

The second slider guides conveniently have a longitudinal length equal to longitudinal lengths of the third and fourth plates respectively. Each of the first, second, third, and fourth plates have equal longitudinal lengths and equal lateral widths respectively, and the third plate is telescopically interfitted within the first slider guides such that the open ends of the third and fourth plates respectively are in fluid communication with the open ends of the first and second plates respectively during operating conditions. A plurality of key strips is monolithically formed in respective top surfaces of the second and fourth plates and respective bottom surfaces of the first and third plates. Such key strips are equidistantly spaced along a major portion of the respective top and bottom surfaces.

The carrier assembly further includes first and second wiper pads. Such a first pad is intercalated between the first and second plates respectively while the second wiper pad is intercalated between the third and fourth plates respectively. Each of the first and second pads advantageously extend into the open ends of the first, second, third, and fourth plates respectively, and the pads are statically affixed in place by the associated ones of the key strips. A pair of anchor brackets is monolithically formed in the top surface of the third plate and extends upwardly and away therefrom and the anchor brackets are located at opposed corners of the closed end of the third plate.

A method for removing moisture from an outer surface of an existing drill pipe while the existing drill pipe is removed from a ground surface includes the steps of: providing a plurality of coextensively shaped rectilinear support rails with axially opposed ends; directly attaching a plurality of coextensively shaped rectilinear end rails to the respective opposed ends of the support rails, wherein each of the end rails has right and left ends respectively; attaching the support rails to a support surface; and removing moisture from the outer surface of the existing drill pipe.

The method further includes the step of directly attaching a plurality of coextensively rectilinear casings to an interior surface of an associated one of the support rails along the longitudinal length thereof. Such casings have axially opposed open ends and a hollow interior such that a continuous passageway extends along the entire longitudinal length thereof. Each of the opposed ends have a threaded interior surface and each of the casings has a longitudinal length that is equal to each of the longitudinal lengths of the support rails. The casings further have a bottom surface registered in parallel with a lower edge of the support rails and disposed subjacent thereto, and each of the casings has a plurality of bores formed in opposed lateral faces of each of the opposed ends thereof and has a centrally registered axis oriented at a right angle to the longitudinal length of the casing.

The method further includes the steps of: directly abutting a lower edge of the end rails against a top surface of the casings when the end rails are attached to the support rails and telescopically interfitting a plurality of coextensively shaped rectilinear beams within the passageways of the casings. Such beams have axially opposed first and second ends respectively, and each of the beams has a plurality of holes formed in opposed lateral surfaces thereof and equidistantly spaced along a longitudinal length thereof. The holes align with associated ones of the bores to provide a continuous conduit therethrough.

The steps further include simultaneously penetrating a plurality of cotter pins through the bores and the openings when the beams are interfitted within the casings for prohibiting the beams from prematurely and undesirably separating during operating conditions and removably attaching a first end of a plurality of threaded shafts to the first ends of the beams. Such shafts have a second end axially opposed from the first end and have a longitudinal length registered in parallel with the longitudinal lengths of the beams. The method further includes the step of providing a plurality of coupling members monolithically formed with the second ends of the shafts. Such coupling members include flattened plates and U-shaped hooks for removably attaching the support rails to the support surface. The method also includes the step for threadably attaching a plurality of adjusting nuts to the shafts by intercalating the adjusting nuts between the first and second ends of the shafts.

The method further includes the step of providing a carrier assembly including a first plate provided with opposed open and closed ends respectively and a plurality of walls extending upwardly at a right angle from a top surface thereof. Such walls are contiguously oriented along laterally opposed outer edges of the first plate and extend along an entire longitudinal length of the first plate. Each of the walls has a groove formed in an exterior surface thereof and extending along a longitudinal length thereof.

The carrier assembly further includes a plurality of spacers monolithically formed with a bottom surface of the first plate and extending downwardly and away therefrom and a second plate coextensively shaped with the first plate that has a top surface monolithically formed with the spacers such that the spacers are intercalated between the first plate and the second plates respectively. The second plate has laterally opposed edges folded downwardly and inwardly toward a centerline of a bottom surface of the second plate such that each of the edges forms a continuous groove along the longitudinal length of the second plate.

The carrier assembly further includes a first plurality of slider guides interfitted within the folds of the second plate and statically attached thereto, wherein the first slider guides extends along a longitudinal length of the folds. The carrier assembly further includes a third plate provided with opposed open and closed ends, a fourth plate coextensively shaped with the third plate, a plurality of second slider guides monolithically formed with a bottom surface of the third plate and a top surface of the fourth plate such that the second slider guides are intercalated between the third and fourth plates respectively. The second slider guides has a longitudinal length equal to longitudinal lengths of the third and fourth plates respectively.

Each of the first, second, third, and fourth plates have equal longitudinal lengths and equal lateral widths respectively, and the third plate is telescopically interfitted within the first slider guides such that the open ends of the third and fourth plates respectively are in fluid communication with the open ends of the first and second plates respectively during operating conditions. A plurality of key strips are monolithically formed in respective top surfaces of the second and fourth plates and respective bottom surfaces of the first and third plates, and the key strips are equidistantly spaced along a major portion of the respective top and bottom surfaces.

The carrier assembly further includes first and second wiper pads wherein the first pad is intercalated between the first and second plates respectively while the second wiper pad is intercalated between the third and fourth plates respectively. Each of the first and second pads extend into the open ends of the first, second, third, and fourth plates respectively, and the pads are statically affixed in place by the associated ones of the key strips. A pair of anchor brackets is monolithically formed in the top surface of the third plate and extends upwardly and away therefrom and the anchor brackets are located at opposed corners of the closed end of the third plate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
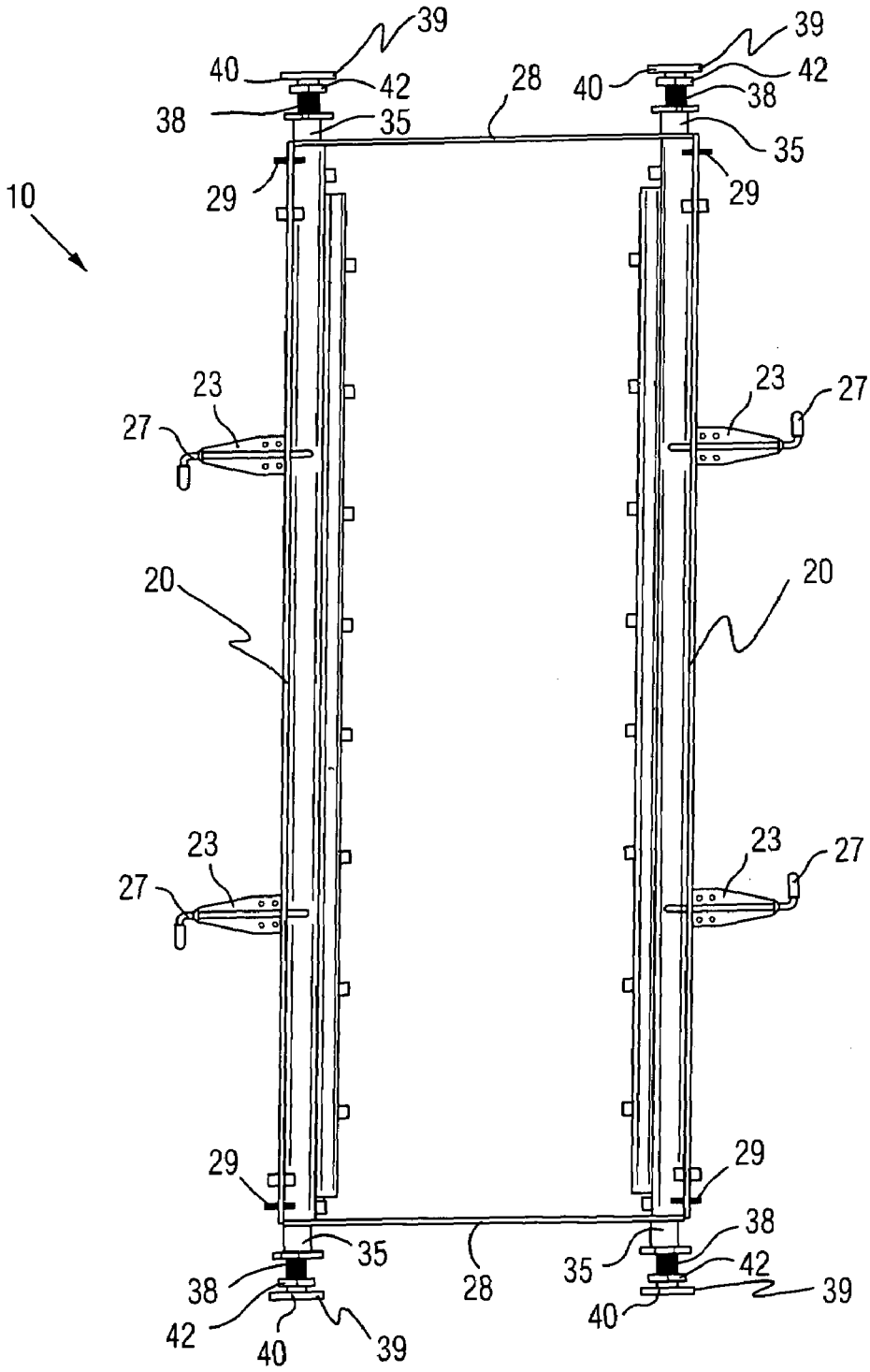
FIG. 1 is a top planar view of the support rails and beams without the carrier assembly and wiper pads fitted therein, in accordance with the present invention.
Figure 2:
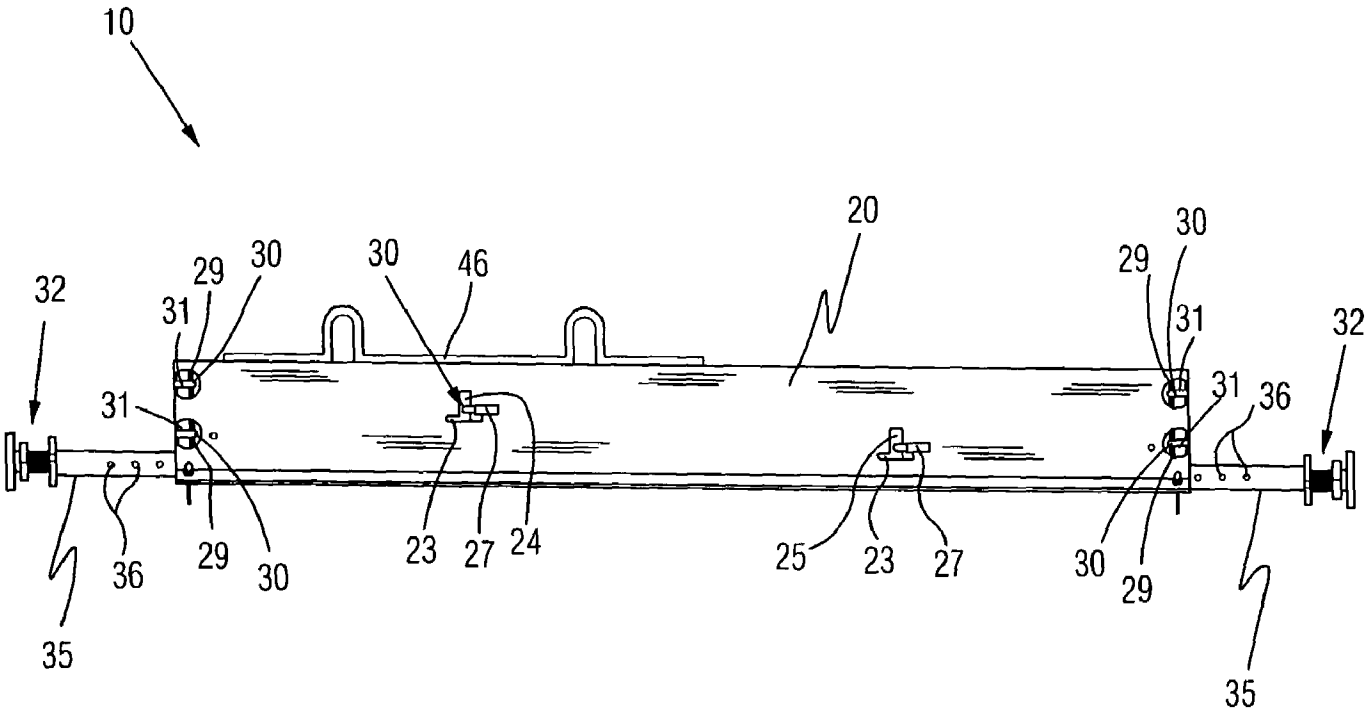
FIG. 2 is a side elevational view of drill pipe wiper system, in accordance with the present invention.
Figure 3:
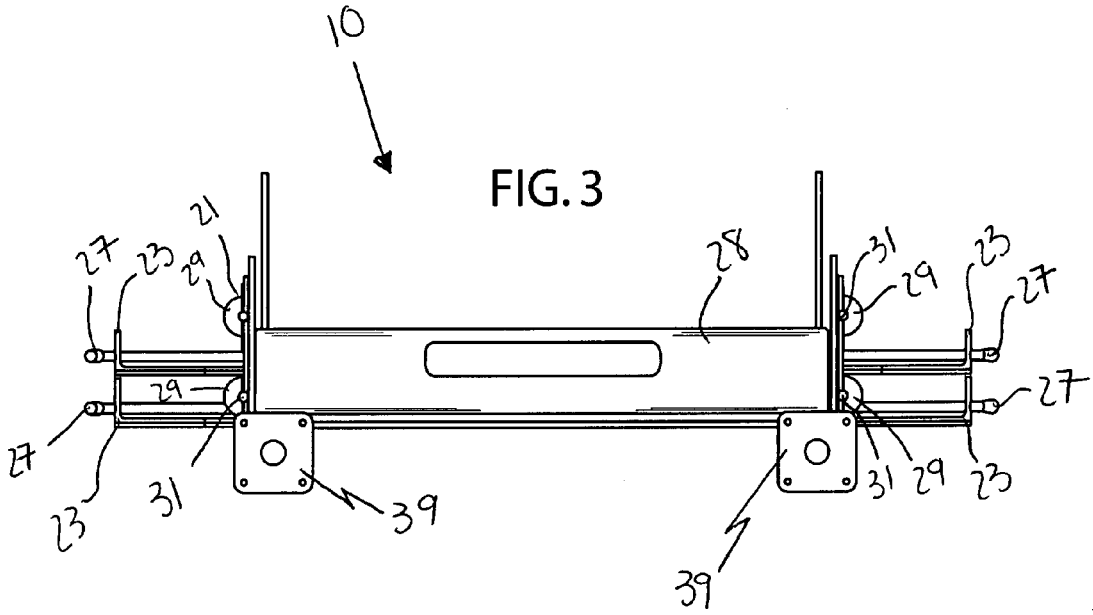
FIG. 3 is a front elevational view of a drill pipe wiper system, in accordance with the present invention.
Figure 4:
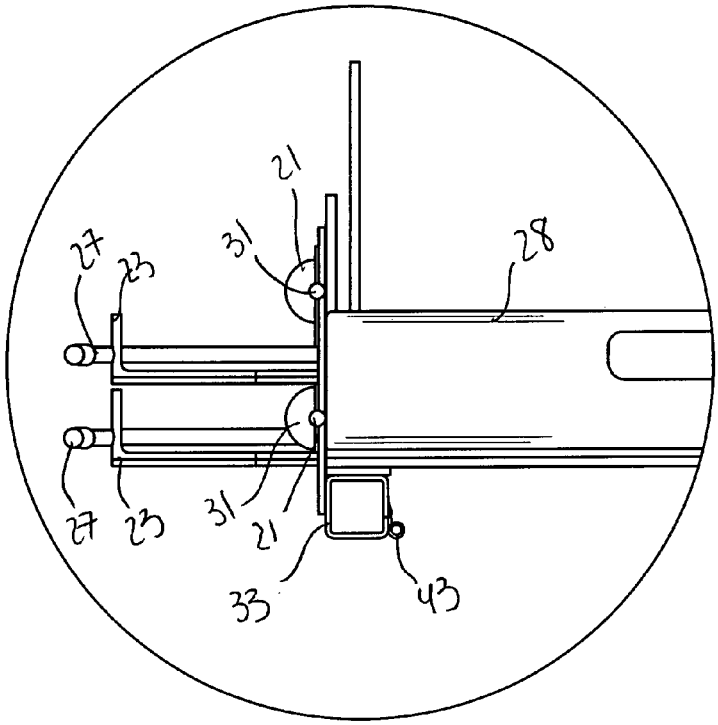
FIG. 4 is a front elevational view of a drill pipe wiper system showing a beam without a coupling member, as shown in FIG. 3.
Figure 5:
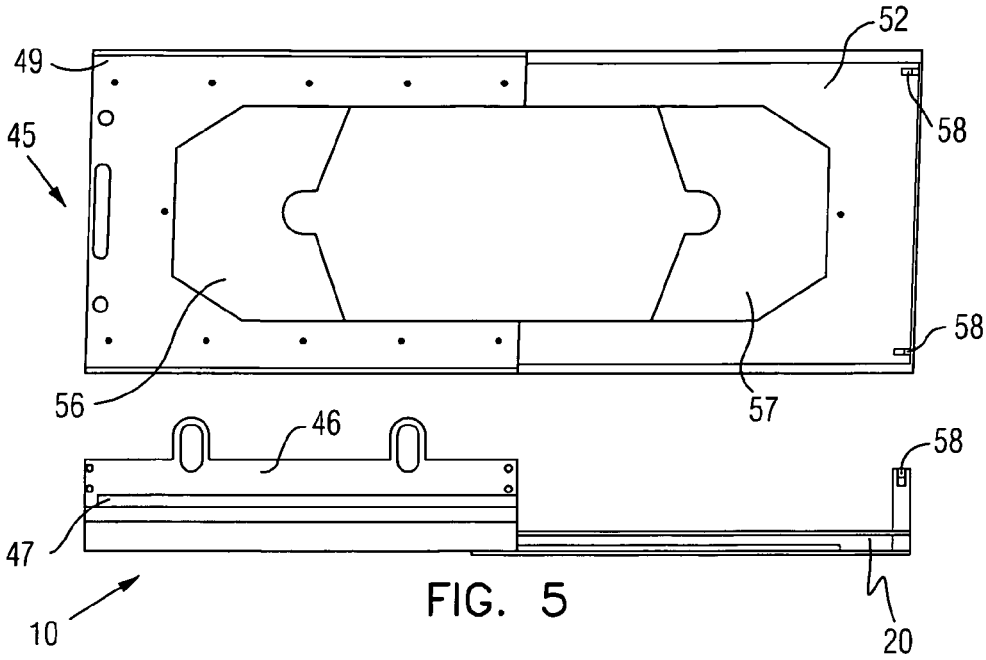
FIG. 5 is a bottom planar and a side elevational view of the drill pipe wiper system without the support rail attached in an open position, in accordance with the present invention.
Figure 6:
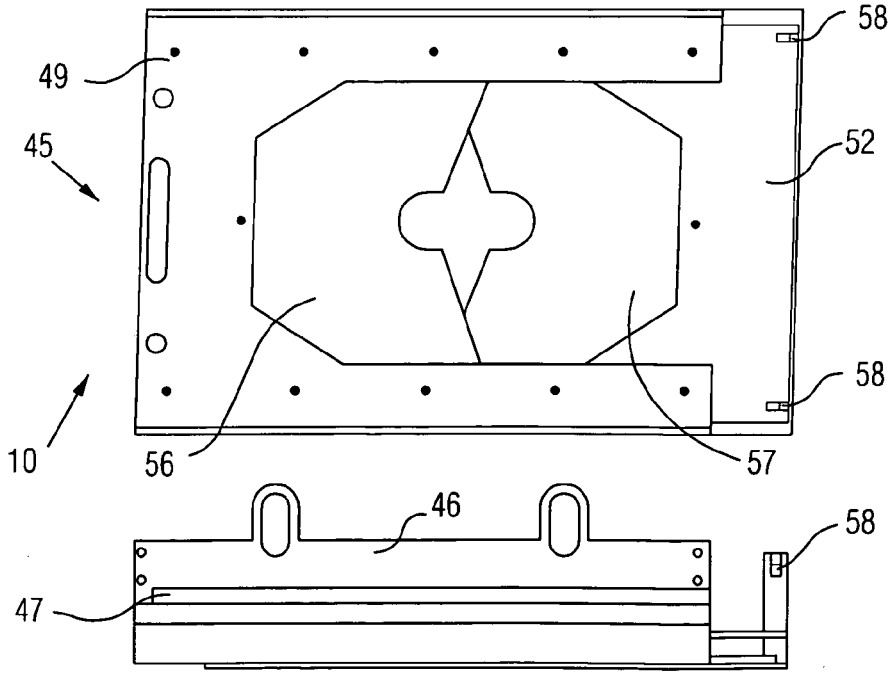
FIG. 6 is a side elevational and bottom planar view of a drill pipe wiper system in a compacted position, in accordance with the present invention.
Figure 7:
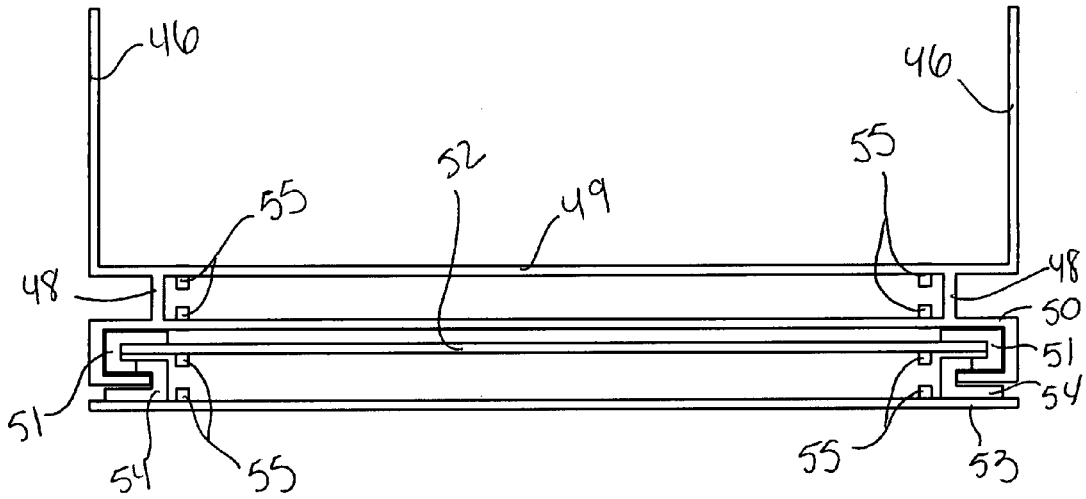
FIG. 7 is a front elevational view of a carrier assembly, in accordance with the present invention.
Figure 8:
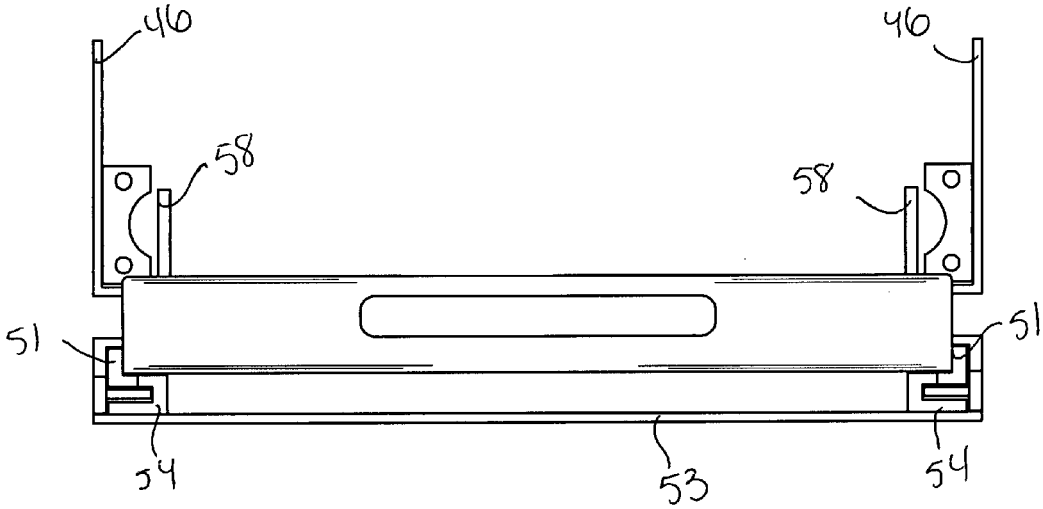
FIG. 8 is a front elevational view of a carrier assembly and moisture removing mechanism, in accordance with the present invention.
Figure 9:
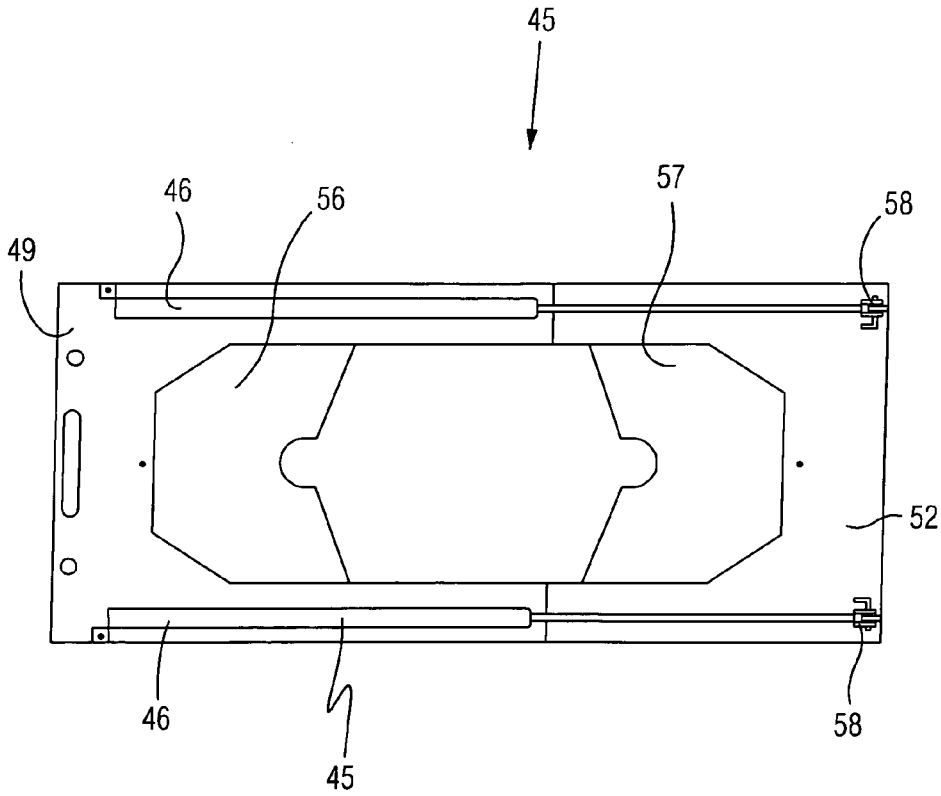
FIG. 9 is a bottom planar view of a drill pipe wiper system, in accordance with the present invention.

The system of this invention is referred to generally in FIGS. 1-12 by the reference numeral 10 and is intended to provide a system for removing moisture from an outer surface of an existing drill pipe while the existing drill pipe is being removed from a ground surface. It should be understood that the system 10 may be used to wipe many different types of pipes and should not be limited to wiping only those types of pipes mentioned herein.

Referring initially to FIGS. 1, 2, 3 and 4, the drill pipe wiper system includes a plurality of coextensively shaped rectilinear support rails 20 with axially opposed ends. Each of such support rails 20 effectively has a plurality of openings 21 formed in the opposed ends of the support rails 20 and located adjacent to a vertical edge thereof. Each of such openings 21 has a centrally registered axis oriented at a right angle to the longitudinal length of the support rails 20, and the openings 21 are equidistantly spaced along a vertical plane registered parallel to the vertical edge of the opposed ends of the support rails 20.

Each of such support rails 20 further includes a plurality of ports penetrating an outer surface of the support rails and equidistantly spaced therealong. Selected ones of such ports is located adjacent to a top edge of the support rails while other ones of the ports are located adjacent to a bottom edge of the support rails 20. Each support rail further conveniently includes a plurality of flanges 23 directly, without the use of intervening characters, attached to the outer surfaces of the support rails 20 and extending outwardly and away therefrom. Each of such flanges 23 has a first portion 24 oriented along the horizontal plane and further has a second portion 25 oriented upwardly and along the vertical plane.

Such a first portion 24 of the flange is advantageously located subjacent to an associated one of the ports of the support rails, and such a second portion 25 is spaced from the outer surface of the support rails 20 and further has a hole formed therein. Each of such holes 26 has a centrally registered axis aligned with a centrally registered axis of an associated one of the ports of the support rails. The respective centrally aligned axes are oriented perpendicular to the longitudinal length of the support rails. The support rails provide a means for holding the system between the table beams of a drilling rig during operation procedures.

Referring again to FIGS. 1, 2, 3 and 4, the support rail further includes a plurality of spring-loaded latch pins 27 suitably shaped and sized which is essential such that a distal end of the latch pins 27 simultaneously penetrates the holes 26 of the second portions of the flanges 23 and the ports of the support rails respectively. Such distal ends of the latch pins 27 directly, without the use of intervening characters, contact the walls and the third and fourth plates respectively of the carrier assembly in such a manner that the carrier assembly is prohibited from prematurely and undesirably exiting the hollow chamber during operating procedures. Each of the latch pins 27 further has a second end oriented perpendicular to the distal end of the latch pin. The latch pins ensure that the carrier assembly does not shift during operation of the pipe wiper system.

Referring to FIGS. 1, 2, 3 and 4, the system further includes a plurality of coextensively shaped rectilinear end rails 28 with right and left ends respectively. Each of such end rails 28 are directly attached to the respective opposed ends of the support rails 20. Each of the end rails 28 effectively includes a plurality of flattened tabs 29 monolithically formed in the right and left ends respectively of the end rails and extending outwardly and away therefrom. Each of such tabs 29 has a top surface oriented in parallel with a top surface of the end rails. The tabs 29 are equidistantly spaced along the respective right and left ends of the end rails 28, and each of the tabs 29 has an aperture 30 formed in a center region thereof and penetrating therethrough.

The end rails 28 further include a plurality of linch pins 31 suitably sized and shaped for penetrating through associated ones of the apertures 30 of the tabs, and the tabs 29 of the end rails are interfitted within associated ones of the openings 21 of the support rails which is critical such that the end rails 28 and the support rails 20 respectively cooperate to form a substantially rectangular-shaped structure. Such a structure conveniently has a hollow chamber formed therein. The linch pins 31 and the tabs 29 of the ends rails 28 respectively cooperate to prevent the end rails from prematurely and undesirably separating from the support rails 20 and thereby maintain the ends rails and the support rails in a fixed and static position during operating conditions. The end rails ensure that the support rails remain stable during operation of the system.

Referring again to FIGS. 1, 2, 3 and 4, the system further includes a mechanism for attaching the support rails to a support surface. Such an attaching mechanism 32 is directly connected, without the use of intervening characters, to the respective opposed ends of the support rails 20 and disposed subjacent thereto. The support rail attaching mechanism 32 includes a plurality of coextensively shaped rectilinear casings 33 with axially opposed open ends. Each of such casings 33 advantageously has a hollow interior which is crucial such that a continuous passageway extends along the entire longitudinal length thereof, and each of the opposed ends has a threaded interior surface. Each of the casings 33 is integrally attached directly to an interior surface of an associated one of the support rails 20 along the longitudinal length thereof and has a longitudinal length that is equal to each of the longitudinal lengths of the support rails 20.

The casings 33 further have a bottom surface registered in parallel with a lower edge of the support rails and further is disposed subjacent thereto. Each of the casings 33 effectively has a plurality of bores formed in opposed lateral faces of each of the opposed ends thereof and has a centrally registered axis oriented at a right angle to the longitudinal length of the casing 33. A lower edge of the end rails abuts directly, without the use of intervening characters, against a top surface of the casings 33 when the end rails 28 are attached to the support rails 20. The attaching mechanism provides a user a means for attaching the support rails securely to a support surface.

Figure 2A:
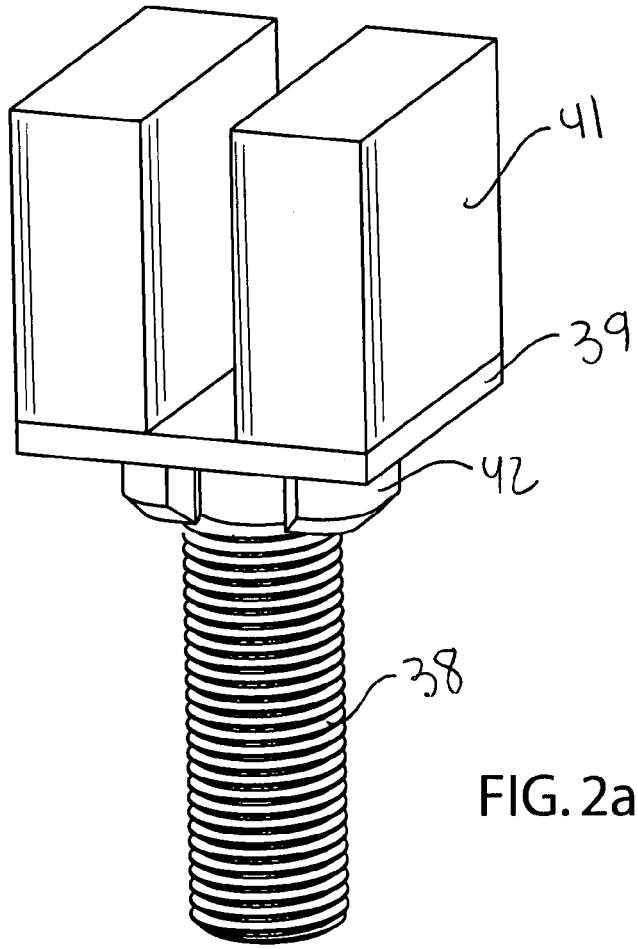
FIG. 2*a* is an enlarged view of a coupling member and shaft, in accordance with the present invention.
Figure 2B:
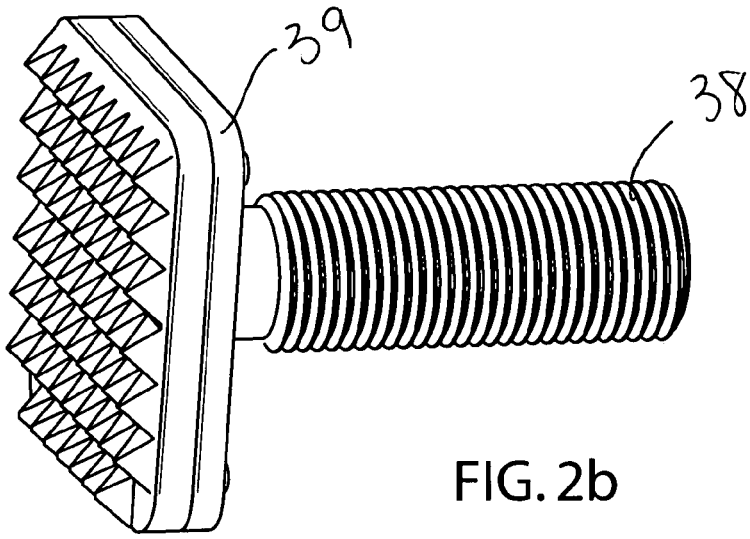
FIG. 2*b* is an enlarged view of a coupling member and shaft, without a hook, as shown in FIG. 2*a*, in accordance with the present invention.

Referring again to FIGS. 1, 2, 2*a*, 2*b* and 4, the support rail attaching mechanism further includes a plurality of coextensively shaped rectilinear beams 35 with axially opposed first and second ends respectively. Such beams 35 are telescopically interfitted within the passageways of the casings 33, and each of the beams 35 has a plurality of holes 36 formed in opposed lateral surfaces thereof and equidistantly spaced along a longitudinal length thereof. Such holes 36 conveniently align with associated ones of the bores to provide a continuous conduit therethrough.

The support rail attaching mechanism further includes a plurality of cotter pins simultaneously penetrated through the bores and the openings when the beams 35 are interfitted within the casings 33 for prohibiting the beams 35 from prematurely and undesirably separating during operating conditions. The mechanism further includes a plurality of threaded shafts 38 with axially opposed first and second ends respectively where the first ends of the shafts 38 are removably attached to the first ends of the beams. Such shafts 38 advantageously have a longitudinal length registered in parallel with the longitudinal lengths of the beams 35.

Referring to FIGS. 1, 2, 2*a*, 2*b*, 3, 5, 6 and 9, the mechanism further includes a plurality of coupling members 39 monolithically formed with the second ends of the shafts. Such coupling members 39 effectively include flattened plates 40 and U-shaped hooks 41. The coupling members 39 are for removably attaching the support rails 20 to the support surface. The coupling members allow a user to remove and attach the support rails to the support surface as needed. Finally, the support rail attaching mechanism includes a plurality of adjusting nuts 42 threadably attached to the shafts 38 and intercalated between the first and second ends thereof.

Referring to FIGS. 1, 2, 5, 6, 7, 8 and 9, the system further includes a rectilinear channel 43 integrally attached to the support rail attaching mechanism 32 for directing drilling fluid back towards the existing drill rig circulating system and a mechanism for removing moisture from the outer surface of the existing drill pipe. Such a moisture removing mechanism is directly attached, without the use of intervening characters, to the support rails 20 and includes a carrier assembly 45 that includes a first plate 49 provided with opposed open and closed ends respectively and has a plurality of walls 46 extending upwardly at a right angle from a top surface thereof. The walls 46 of the carrier assembly are contiguously oriented along laterally opposed outer edges of the first plate 49, the walls 46 extending along an entire longitudinal length of the first plate 49, each of the walls 46 has a groove 47 formed in an exterior surface thereof and conveniently extending along a longitudinal length thereof, a plurality of spacers 48 monolithically formed with a bottom surface of the first plate 49 and extending downwardly and away therefrom. The moisture removing mechanism strips fluid from the external surface of a drill pipe.

Referring again to FIGS. 1, 2, 5, 6, 7, 8 and 9, the carrier assembly of the moisture removing mechanism further includes a second plate 50 coextensively shaped with the first plate 49 and has a top surface monolithically formed with the spacers 48 such that the spacers 48 are intercalated between the first plate 49 and the second plates 50 respectively. Such a second plate 50 advantageously has laterally opposed edges folded downwardly and inwardly toward a centerline of a bottom surface of the second plate 50 which is vital such that each of the edges forms a continuous groove along the longitudinal length of the second plate.

The carrier assembly further includes a plurality of first slider guides 51 interfitted within the folds of the second plate 50 and statically attached thereto. Such first slider guides 51 effectively extend along a longitudinal length of the folds. The carrier assembly further includes a third plate 52 provided with opposed open and closed ends; a fourth plate 53 coextensively shaped with the third plate 52 and a plurality of second slider guides 54 monolithically formed with a bottom surface of the third plate 52 and a top surface of the fourth plate 53 such that the second slider guides 54 are intercalated between the third and fourth plates 52, 53 respectively.

The second slider guides 54 conveniently have a longitudinal length equal to longitudinal lengths of the third and fourth plates 52, 53 respectively. Each of the first, second, third, and fourth plates 50, 52, 53 have equal longitudinal lengths and equal lateral widths respectively, and the third plate 52 is telescopically interfitted within the first slider guides 51 which is necessary such that the open ends of the third and fourth plates respectively are in fluid communication with the open ends of the first and second plates respectively during operating conditions. A plurality of key strips 55 is monolithically formed in respective top surfaces of the second and fourth plates 50, 53 and respective bottom surfaces of the first and third plates 49, 52. Such key strips 55 are equidistantly spaced along a major portion of the respective top and bottom surfaces. The first and second sets of slider glides provide a means for allowing the moisture removing mechanism to move freely along the drill pipe.

The carrier assembly further includes first and second wiper pads 56, 57. Such a first pad 56 is intercalated between the first and second plates 49, 50 respectively while the second wiper pad 57 is intercalated between the third and fourth plates 52, 53 respectively. Each of the first and second pads 56, 57 advantageously extend into the open ends of the first, second, third, and fourth plates respectively, and the pads are statically affixed in place by the associated ones of the key strips 55. A pair of anchor brackets 58 is monolithically formed in the top surface of the third plate 52 and extends upwardly and away therefrom and the anchor brackets 58 are located at opposed corners of the closed end of the third plate 52. The first and second wiper pads facilitate the removal of the fluid from the pipe and are held in place, against the pipes, between the first and second plates and third and fourth plates, respectively.

The coupling members provide the unexpected benefit of allowing a user to quickly dismantle the support rails from the support surface, in an emergency situation. In addition, the carrier assembly provides a means for a user to quickly change the wiper pads, even during operation of the system. Such benefits overcome the prior art shortcomings.

In use, a method for removing moisture from an outer surface of an existing drill pipe while the existing drill pipe is removed from a ground surface includes the steps of: providing a plurality of coextensively shaped rectilinear support rails 20 with axially opposed ends; directly attaching a plurality of coextensively shaped rectilinear end rails 28 to the respective opposed ends of the support rails 20, wherein each of the end rails 28 has right and left ends respectively; attaching the support rails 20 to a support surface; and removing moisture from the outer surface of the existing drill pipe.

In use, the method further includes the step of directly attaching a plurality of coextensively rectilinear casings 33 to an interior surface of an associated one of the support rails 20 along the longitudinal length thereof. Such casings 33 have axially opposed open ends and a hollow interior such that a continuous passageway extends along the entire longitudinal length thereof. Each of the opposed ends have a threaded interior surface and each of the casings 33 has a longitudinal length that is equal to each of the longitudinal lengths of the support rails 20. The casings 33 further have a bottom surface registered in parallel with a lower edge of the support rails 20 and disposed subjacent thereto, and each of the casings 33 has a plurality of bores formed in opposed lateral faces of each of the opposed ends thereof and has a centrally registered axis oriented at a right angle to the longitudinal length of the casing 33.

In use, the method further includes the steps of: directly abutting a lower edge of the end rails 28 against a top surface of the casings 33 when the end rails 28 are attached to the support rails 20 and telescopically interfitting a plurality of coextensively shaped rectilinear beams 35 within the passageways of the casings 33. Such beams 35 have axially opposed first and second ends respectively, and each of the beams 35 has a plurality of holes 36 formed in opposed lateral surfaces thereof and equidistantly spaced along a longitudinal length thereof. The holes 36 align with associated ones of the bores to provide a continuous conduit therethrough.

In use, the steps further include simultaneously penetrating a plurality of cotter pins through the bores and the openings when the beams 35 are interfitted within the casings 33 for prohibiting the beams 35 from prematurely and undesirably separating during operating conditions and removably attaching a first end of a plurality of threaded shafts 38 to the first ends of the beams 35. Such shafts 38 have a second end axially opposed from the first end and have a longitudinal length registered in parallel with the longitudinal lengths of the beams 35. The method further includes the step of providing a plurality of coupling members 39 monolithically formed with the second ends of the shafts 38. Such coupling members 39 include flattened plates and U-shaped hooks 41 for removably attaching the support rails 20 to the support surface. The method also includes the step of threadably attaching a plurality of adjusting nuts 42 to the shafts 38 by intercalating the adjusting nuts between the first and second ends of the shafts 38.

In use, the method further includes the step of providing a carrier assembly 45 including a first plate 49 provided with opposed open and closed ends respectively and a plurality of walls 46 extending upwardly at a right angle from a top surface thereof. Such walls 46 are contiguously oriented along laterally opposed outer edges of the first plate 49 and extend along an entire longitudinal length of the first plate 49. Each of the walls 46 has a groove 47 formed in an exterior surface thereof and extending along a longitudinal length thereof.

The carrier assembly 45 further includes a plurality of spacers 48 monolithically formed with a bottom surface of the first plate 49 and extending downwardly and away therefrom and a second plate 50 coextensively shaped with the first plate 49 that has a top surface monolithically formed with the spacers 48 such that the spacers 48 are intercalated between the first plate 49 and the second plates 50 respectively. The second plate 50 has laterally opposed edges folded downwardly and inwardly toward a centerline of a bottom surface of the second plate 50 such that each of the edges forms a continuous groove 47 along the longitudinal length of the second plate.

The carrier assembly further includes a first plurality of slider guides 51 interfitted within the folds of the second plate 50 and statically attached thereto, wherein the first slider guides 51 extends along a longitudinal length of the folds. The carrier assembly further includes a third plate 52 provided with opposed open and closed ends, a fourth plate 53 coextensively shaped with the third plate 52, a plurality of second slider guides 54 monolithically formed with a bottom surface of the third plate 52 and a top surface of the fourth plate 53 such that the second slider guides 54 are intercalated between the third and fourth plates 52, 53 respectively. The second slider guides 54 have a longitudinal length equal to longitudinal lengths of the third and fourth plates respectively.

Each of the first, second, third, and fourth plates 49, 50, 52, 53 have equal longitudinal lengths and equal lateral widths respectively, and the third plate is telescopically interfitted within the first slider guides 51 such that the open ends of the third and fourth plates respectively are in fluid communication with the open ends of the first and second plates respectively during operating conditions. A plurality of key strips 55 are monolithically formed in respective top surfaces of the second and fourth plates 52, 53 and respective bottom surfaces of the first and third plates, and the key strips 55 are equidistantly spaced along a major portion of the respective top and bottom surfaces.

The carrier assembly further includes first and second wiper pads 56, 57 wherein the first pad 56 is intercalated between the first and second plates 49, 50 respectively while the second wiper pad 57 is intercalated between the third and fourth plates 52, 53 respectively. Each of the first and second pads 56, 57 extend into the open ends of the first, second, third, and fourth plates respectively, and the pads are statically affixed in place by the associated ones of the key strips 55. A pair of anchor brackets 58 is monolithically formed in the top surface of the third plate 52 and extends upwardly and away therefrom and the anchor brackets 58 are located at opposed corners of the closed end of the third plate.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A drill pipe wiper system for removing moisture from an outer surface of an existing drill pipe while the existing drill pipe is being removed from a ground surface, said drill pipe wiper system comprising:

a plurality of coextensively shaped rectilinear support rails having axially opposed ends;

a plurality of coextensively shaped rectilinear end rails having right and left ends respectively, each of said end rails being directly attached to said respective opposed ends of said support rails;

means for attaching said support rails to a support surface, said attaching means being directly connected to said respective opposed ends of said support rails and disposed subjacent thereto; and means for removing moisture from the outer surface of the existing drill pipe, said moisture removing means being directly attached to said support rails.

2. The drill pipe wiper system of claim 1, wherein each of said support rails has a plurality of openings formed in said opposed ends of said support rails and located adjacent to a vertical edge thereof, each of said openings having a centrally registered axis oriented at a right angle to said longitudinal length of said support rails, said openings being equidistantly spaced along a vertical plane registered parallel to said vertical edge of said opposed ends of said support rails.

3. The drill pipe wiper system of claim 2, wherein each of said end rails comprises:

a plurality of flattened tabs monolithically formed in said right and left ends respectively of said end rails and extending outwardly and away therefrom, each of said tabs having a top surface oriented in parallel with a top surface of said end rails, said tabs being equidistantly spaced along said respective right and left ends of said end rails, each of said tabs having an aperture formed in a center region thereof and penetrating therethrough; and a plurality of linch pins suitably sized and shaped for penetrating through associated ones of said apertures of said tabs;

wherein said tabs of said end rails are interfitted within associated ones of said openings of said support rails such that said end rails and said support rails respectively cooperate to form a substantially rectangular-shaped structure, said structure having a hollow chamber formed therein;

wherein said linch pins and said tabs of said ends rails respectively cooperate to prevent said end rails from prematurely and undesirably separating from said support rails and thereby maintain said ends rails and said support rails in a fixed and static position during operating conditions.

4. The drill pipe wiper system of claim 3, wherein said support rail attaching means comprising:

a plurality of coextensively shaped rectilinear casings having axially opposed open ends, each of said casings having a hollow interior such that a continuous passageway extends along the entire longitudinal length thereof, each of said opposed ends having a threaded interior surface, each of said casings being integrally attached directly to an interior surface of an associated one of said support rails along said longitudinal length thereof, each of said casings having a longitudinal length that is equal to each of said longitudinal lengths of said support rails, said casings having a bottom surface registered in parallel with a lower edge of said support rails and further being disposed subjacent thereto, each of said casings having a plurality bores formed in opposed lateral faces of each of said opposed ends thereof and having a centrally registered axis oriented at a right angle to said longitudinal length of said casing;

wherein a lower edge of said end rails abuts directly against a top surface of said casings when said end rails are attached to said support rails;

a plurality of coextensively shaped rectilinear beams having axially opposed first and second ends respectively, said beams being telescopically interfitted within said passageways of said casings, each of said beams having a plurality of holes formed in opposed lateral surfaces thereof and equidistantly spaced along a longitudinal length thereof, said holes aligning with associated ones of said bores to provide a continuous conduit therethrough;

a plurality of cotter pins simultaneously penetrated through said bores and said holes when said beams are interfitted within said casings for prohibiting said beams from prematurely and undesirably separating during operating conditions;

a plurality of threaded shafts having axially opposed first and second ends respectively, said first ends of said shafts being removably attached to said first ends of said beams, said shafts having a longitudinal length registered in parallel with said longitudinal lengths of said beams;

a plurality of coupling members monolithically formed with said second ends of said shafts, said coupling members including flattened plates and U-shaped hooks, said coupling members for removably attaching said support rails to the support surface; and a plurality of adjusting nuts threadably attached to said shafts and intercalated between said first and second ends thereof.

5. The drill pipe wiper system of claim 4, wherein said moisture removing means comprises:

a carrier assembly including a first plate provided with opposed open and closed ends respectively and having a plurality of walls extending upwardly at a right angle from a top surface thereof, said walls being contiguously oriented along laterally opposed outer edges of said first plate, said walls extending along an entire longitudinal length of said first plate, each of said walls having a groove formed in an exterior surface thereof and extending along a longitudinal length thereof, a plurality of spacers monolithically formed with a bottom surface of said first plate and extending downwardly and away therefrom, a second plate coextensively shaped with said first plate and having a top surface monolithically formed with said spacers such that said spacers are intercalated between said first plate and said second plates respectively, said second plate having laterally opposed edges folded downwardly and inwardly toward a centerline of a bottom surface of said second plate such that each of said edges forms a continuous groove along the longitudinal length of said second plate, a plurality of first slider guides interfitted within said folds of said second plate and statically attached thereto, said first slider guides extending along a longitudinal length of said folds, a third plate provided with opposed open and closed ends, a fourth plate coextensively shaped with said third plate, a plurality of second slider guides monolithically formed with a bottom surface of said third plate and a top surface of said fourth plate such that said second slider guides are intercalated between said third and fourth plates respectively, said second slider guides having a longitudinal length equal to longitudinal lengths of said third and fourth plates respectively, wherein each of said first, second, third, and fourth plates have equal longitudinal lengths and equal lateral widths respectively, wherein said third plate is telescopically interfitted within said first slider guides such that said open ends of said third and fourth plates respectively are in fluid communication with said open ends of said first and second plates respectively during operating conditions, a plurality of key strips monolithically formed in respective top surfaces of said second and fourth plates and respective bottom surfaces of said first and third plates, said key strips being equidistantly spaced along a major portion of said respective top and bottom surfaces, first and second wiper pads, said first pad being intercalated between said first and second plates respectively while said second wiper pad is intercalated between said third and fourth plates respectively, each of said first and second pads extending into said open ends of said first, second, third, and fourth plates respectively, said pads being statically affixed in place by said associated ones of said key strips, and a pair of anchor brackets monolithically formed in said top surface of said third plate and extending upwardly and away therefrom, said anchor brackets being located at opposed corners of said closed end of said third plate.

6. The drill pipe wiper system of claim 5, wherein each of said support rails further comprises:

a plurality of ports penetrating an outer surface of said support rails and equidistantly spaced therealong, selected ones of said ports being located adjacent to a top edge of said support rails while other ones of said ports are located adjacent to a bottom edge of said support rails;

a plurality of flanges directly attached to said outer surfaces of said support rails and extending outwardly and away therefrom, each of said flanges having a first portion oriented along the horizontal plane and further having a second portion oriented upwardly and along the vertical plane, said first portion being located subjacent to an associated one of said ports of said support rails, said second portion being spaced from said outer surface of said support rails and further having a hole formed therein, each of said holes having a centrally registered axis aligned with a centrally registered axis of an associated one of said ports of said support rails, said respective centrally aligned axes being oriented perpendicular to said longitudinal length of said support rails; and a plurality of spring-loaded latch pins suitably shaped and sized such that a distal end of said latch pins simultaneously penetrates said holes of said second portions of said flanges and said ports of said support rails respectively, said distal ends of said latch pins directly contacting said walls and said third and fourth plates respectively of said carrier assembly in such a manner that said carrier assembly is prohibited from prematurely and undesirably exiting said hollow chamber during operating procedures, each of said latch pins having a second end oriented perpendicular to said distal end of said latch pin.

7. A drill pipe wiper system for removing moisture from an outer surface of an existing drill pipe while the existing drill pipe is being removed from a ground surface, said drill pipe wiper system comprising:

a plurality of coextensively shaped rectilinear support rails having axially opposed ends a plurality of coextensively shaped rectilinear end rails having right and left ends respectively, each of said end rails being directly attached to said respective opposed ends of said support rails;

means for attaching said support rails to a support surface, said attaching means being directly connected to said respective opposed ends of said, support rails and disposed subjacent thereto;

a rectilinear channel integrally attached to said support rail attaching means for directing drilling fluid back towards the existing drill rig circulating system; and means for removing moisture from the outer surface of the existing drill pipe, said moisture removing means being directly attached to said support rails.

8. The drill pipe wiper system of claim 7, wherein each of said support rails has a plurality of openings formed in said opposed ends of said support rails and located adjacent to a vertical edge thereof, each of said openings having a centrally registered axis oriented at a right angle to said longitudinal length of said support rails, said openings being equidistantly spaced along a vertical plane registered parallel to said vertical edge of said opposed ends of said support rails.

9. The drill pipe wiper system of claim 8, wherein each of said end rails comprises:

a plurality of flattened tabs monolithically formed in said right and left ends respectively of said end rails and extending outwardly and away therefrom, each of said tabs having a top surface oriented in parallel with a top surface of said end rails, said tabs being equidistantly spaced along said respective right and left ends of said end rails, each of said tabs having an aperture formed in a center region thereof and penetrating therethrough; and a plurality of linch pins suitably sized and shaped for penetrating through associated ones of said apertures of said tabs;

wherein said tabs of said end rails are interfitted within associated ones of said openings of said support rails such that said end rails and said support rails respectively cooperate to form a substantially rectangular-shaped structure, said structure having a hollow chamber formed therein;

wherein said linch pins and said tabs of said ends rails respectively cooperate to prevent said end rails from prematurely and undesirably separating from said support rails and thereby maintain said ends rails and said support rails in a fixed and static position during operating conditions.

10. The drill pipe wiper system of claim 9, wherein said support rail attaching means comprising:

a plurality of coextensively shaped rectilinear casings having axially opposed open ends, each of said casings having a hollow interior such that a continuous passageway extends along the entire longitudinal length thereof, each of said opposed ends having a threaded interior surface, each of said casings being integrally attached directly to an interior surface of an associated one of said support rails along said longitudinal length thereof, each of said casings having a longitudinal length that is equal to each of said longitudinal lengths of said support rails, said casings having a bottom surface registered in parallel with a lower edge of said support rails and further being disposed subjacent thereto, each of said casings having a plurality bores formed in opposed lateral faces of each of said opposed ends thereof and having a centrally registered axis oriented at a right angle to said longitudinal length of said casing;

wherein a lower edge of said end rails abuts directly against a top surface of said casings when said end rails are attached to said support rails;

a plurality of coextensively shaped rectilinear beams having axially opposed first and second ends respectively, said beams being telescopically interfitted within said passageways of said casings, each of said beams having a plurality of holes formed in opposed lateral surfaces thereof and equidistantly spaced along a longitudinal length thereof, said holes aligning with associated ones of said bores to provide a continuous conduit therethrough;

a plurality of cotter pins simultaneously penetrated through said bores and said holes when said beams are interfitted within said casings for prohibiting said beams from prematurely and undesirably separating during operating conditions;

a plurality of threaded shafts having axially opposed first and second ends respectively, said first ends of said shafts being removably attached to said first ends of said beams, said shafts having a longitudinal length registered in parallel with said longitudinal lengths of said beams a plurality of coupling members monolithically formed with said second ends of said shafts, said coupling members including flattened plates and U-shaped hooks, said coupling members for removably attaching said support rails to the support surface; and a plurality of adjusting nuts threadably attached to said shafts and intercalated between said first and second ends thereof.

11. The drill pipe wiper system of claim 10, wherein said moisture removing means comprises:

a carrier assembly including a first plate provided with opposed open and closed ends respectively and having a plurality of walls extending upwardly at a right angle from a top surface thereof, said walls being contiguously oriented along laterally opposed outer edges of said first plate, said walls extending along an entire longitudinal length of said first plate, each of said walls having a groove formed in an exterior surface thereof and extending along a longitudinal length thereof, a plurality of spacers monolithically formed with a bottom surface of said first plate and extending downwardly and away therefrom, a second plate coextensively shaped with said first plate and having a top surface monolithically formed with said spacers such that said spacers are intercalated between said first plate and said second plates respectively, said second plate having laterally opposed edges folded downwardly and inwardly toward a centerline of a bottom surface of said second plate such that each of said edges forms a continuous groove along the longitudinal length of said second plate, a plurality of first slider guides interfitted within said folds of said second plate and statically attached thereto, said first slider guides extending along a longitudinal length of said folds, a third plate provided with opposed open and closed ends, a fourth plate coextensively shaped with said third plate, a plurality of second slider guides monolithically formed with a bottom surface of said third plate and a top surface of said fourth plate such that said second slider guides are intercalated between said third and fourth plates respectively, said second slider guides having a longitudinal length equal to longitudinal lengths of said third and fourth plates respectively, wherein each of said first, second, third, and fourth plates have equal longitudinal lengths and equal lateral widths respectively, wherein said third plate is telescopically interfitted within said first slider guides such that said open ends of said third and fourth plates respectively are in fluid communication with said open ends of said first and second plates respectively during operating conditions, a plurality of key strips monolithically formed in respective top surfaces of said second and fourth plates and respective bottom surfaces of said first and third plates, said key strips being equidistantly spaced along a major portion of said respective top and bottom surfaces, first and second wiper pads, said first pad being intercalated between said first and second plates respectively while said second wiper pad is intercalated between said third and fourth plates respectively, each of said first and second pads extending into said open ends of said first, second, third, and fourth plates respectively, said pads being statically affixed in place by said associated ones of said key strips, and a pair of anchor brackets monolithically formed in said top surface of said third plate and extending upwardly and away therefrom, said anchor brackets being located at opposed corners of said dosed end of said third plate.

12. The drill pipe wiper system of claim 11, wherein each of said support rails further comprises:

a plurality of ports penetrating an outer surface of said support rails and equidistantly spaced therealong, selected ones of said ports being located adjacent to a top edge of said support rails while other ones of said ports are located adjacent to a bottom edge of said support rails;

a plurality of flanges directly attached to said outer surfaces of said support rails and extending outwardly and away therefrom, each of said flanges having a first portion oriented along the horizontal plane and further having a second portion oriented upwardly and along the vertical plane, said first portion being located subjacent to an associated one of said ports of said support rails, said second portion being spaced from said outer surface of said support rails and further having a hole formed therein, each of said holes having a centrally registered axis aligned with a centrally registered axis of an associated one of said ports of said support rails, said respective centrally aligned axes being oriented perpendicular to said longitudinal length of said support rails; and a plurality of spring-loaded latch pins suitably shaped and sized such that a distal end of said latch pins simultaneously penetrates said holes of said second portions of said flanges and said ports of said support rails respectively, said distal ends of said latch pins directly contacting said walls and said third and fourth plates respectively of said carrier assembly in such a manner that said carrier assembly is prohibited from prematurely and undesirably exiting said hollow chamber during operating procedures, each of said latch pins having a second end oriented perpendicular to said distal end of said latch pin.

13. A method for removing moisture from an outer surface of an existing drill pipe while the existing drill pipe is being removed from a ground surface, said method comprising the steps of:

a. providing a plurality of coextensively shaped rectilinear support rails having axially opposed ends;

b. directly attaching a plurality of coextensively shaped rectilinear end rails to said respective opposed ends of said support rails, each of said end, rails having right and left ends respectively;

c. attaching said support rails to a support surface; and d. removing moisture from the outer surface of the existing drill pipe;

wherein each of said support rails has a plurality of openings formed in said opposed ends of said support rails and located adjacent to a vertical edge thereof, each of said openings having a centrally registered axis oriented at a right angle to said longitudinal length of said support rails, said openings being equidistantly spaced along a vertical plane registered parallel to said vertical edge of said opposed ends of said support rails;

wherein each of said end rails comprises:

a plurality of flattened tabs monolithically formed in said right and left ends respectively of said end rails and extending outwardly and away therefrom, each of said tabs having a top surface oriented in parallel with a top surface of said end rails, said tabs being equidistantly spaced along said respective right and left ends of said end rails, each of said tabs having an aperture formed in a center region thereof and penetrating therethrough; and a plurality of inch pins suitably sized and shaped for penetrating through associated ones of said apertures of said tabs;

wherein said tabs of said end rails are interfitted within associated ones of said openings of said support rails such that said end rails and said support rails respectively cooperate to form a substantially rectangular-shaped structure, said structure having a hollow chamber formed therein;

wherein said linch pins and said tabs of said ends rails respectively cooperate to prevent said end rails from prematurely and undesirably separating from said support rails and thereby maintain said ends rails and said support rails in a fixed and static position during operating conditions.

14. The method of claim 13, wherein step c. comprises the steps of:

i. directly attaching a plurality of coextensively rectilinear casings to an interior surface of an associated one of said support rails along said longitudinal length thereof, said casings having axially opposed open ends, each of said casings having a hollow interior such that a continuous passageway extends along the entire longitudinal length thereof, each of said opposed ends having a threaded interior surface, each of said casings having a longitudinal length that is equal to each of said longitudinal lengths of said support rails, said casings having a bottom surface registered in parallel with a lower edge of said support rails and further being disposed subjacent thereto, each of said casings having a plurality bores formed in opposed lateral faces of each of said opposed ends thereof and having a centrally registered axis oriented at a right angle to said longitudinal length of said casing;

ii. directly abutting a lower edge of said end rails against a top surface of said casings when said end rails are attached to said support rails;

iii. telescopically interfitting a plurality of coextensively shaped rectilinear beams within said passageways of said casings, said beams having axially opposed first and second ends respectively, each of said beams having a plurality of holes formed in opposed lateral surfaces thereof and equidistantly spaced along a longitudinal length thereof, said holes aligning with associated ones of said bores to provide a continuous conduit therethrough;

iv. simultaneously penetrating a plurality of cotter pins through said bores and said openings when said beams are interfitted within said casings for prohibiting said beams from prematurely and undesirably separating during operating conditions;

v. removably attaching a first end of a plurality of threaded shafts to said first ends of said beams, said shafts having a second end axially opposed from said first end, said shafts having a longitudinal length registered in parallel with said longitudinal lengths of said beams;

vi. providing a plurality of coupling members monolithically formed with said second ends of said shafts, said coupling members including flattened plates and U-shaped hooks, said coupling members for removably attaching said support rails to the support surface; and vii. threadably attaching a plurality of adjusting nuts to said shafts by intercalating said adjusting nuts between said first and second ends of said shafts.

15. The method of claim 14, wherein step d. comprises the steps of:

i. providing a carrier assembly including a first plate provided with opposed open and dosed ends respectively and having a plurality of walls extending upwardly at a right angle from a top surface thereof, said walls being contiguously oriented along laterally opposed outer edges of said first plate, said walls extending along an entire longitudinal length of said first plate, each of said walls having a groove formed in an exterior surface thereof and extending along a longitudinal length thereof, a plurality of spacers monolithically formed with a bottom surface of said first plate and extending downwardly and away therefrom, a second plate coextensively shaped with said first plate and having a top surface monolithically formed with said spacers such that said spacers are intercalated between said first plate and said second plates respectively, said second plate having laterally opposed edges folded downwardly and inwardly toward a centerline of a bottom surface of said second plate such that each of said edges forms a continuous groove along the longitudinal length of said second plate, a plurality of first plurality of slider guides interfitted within said folds of said second plate and statically attached thereto, said first slider guides extending along a longitudinal length of said folds, a third plate provided with opposed open and dosed ends, a fourth plate coextensively shaped with said third plate, a plurality of second slider guides monolithically formed with a bottom surface of said third plate and a top surface of said fourth plate such that said second slider guides are intercalated between said third and fourth plates respectively, said second slider guides having a longitudinal length equal to longitudinal lengths of said third and fourth plates respectively, wherein each of said first, second, third, and fourth plates have equal longitudinal lengths and equal lateral widths respectively, wherein said third plate is telescopically interfitted within said first slider guides such that said open ends of said third and fourth plates respectively are in fluid communication with said open ends of said first and second plates respectively during operating conditions, a plurality of key strips monolithically formed in respective top surfaces of said second and fourth plates and respective bottom surfaces of said first and third plates, said key strips being equidistantly spaced along a major portion of said respective top and bottom surfaces, first and second wiper pads, said first pad being intercalated between said first and second plates respectively while said second wiper pad is intercalated between said third and fourth plates respectively, each of said first and second pads extending into said open ends of said first, second, third, and fourth plates respectively, said pads being statically affixed in place by said associated ones of said key strips, and a pair of anchor brackets monolithically formed in said top surface of said third plate and extending upwardly and away therefrom, said anchor brackets being located at opposed corners of said closed end of said third plate.

16. The method of claim 15, wherein each of said support rails further comprises:

a plurality of ports penetrating an outer surface of said support rails and equidistantly spaced therealong, selected ones of said ports being located adjacent to a top edge of said support rails while other ones of said ports are located adjacent to a bottom edge of said support rails;

a plurality of flanges directly attached to said outer surfaces of said support rails and extending outwardly and away therefrom, each of said flanges having a first portion oriented along the horizontal plane and further having a second portion oriented upwardly and along the vertical plane, said first portion being located subjacent to an associated one of said ports of said support rails, said second portion being spaced from said outer surface of said support rails and further having a hole formed therein, each of said holes having a centrally registered axis aligned with a centrally registered axis of an associated one of said ports of said support rails, said respective centrally aligned axes being oriented perpendicular to said longitudinal length of said support rails; and a plurality of spring-loaded latch pins suitably shaped and sized such that a distal end of said latch pins simultaneously penetrates said holes of said second portions of said flanges and said ports of said support rails respectively, said distal ends of said latch pins directly contacting said walls and said third and fourth plates respectively of said carrier assembly in such a manner that said carrier assembly is prohibited from prematurely and undesirably exiting said hollow chamber during operating procedures, each of said latch pins having a second end oriented perpendicular to said distal end of said latch pin.

* * * * *